United States Patent [19]

Fong

[11] Patent Number: 4,515,658

[45] Date of Patent: May 7, 1985

[54] RETENTION AIDS

[75] Inventor: Dodd W. Fong, Naperville, Ill.

[73] Assignee: Nalco Chemical Company, Oak Brook, Ill.

[21] Appl. No.: 642,280

[22] Filed: Aug. 20, 1984

[51] Int. Cl.[3] ..... D21H 3/38

[52] U.S. Cl. ..... 162/168.4; 162/168.5; 525/326.7; 526/263

[58] Field of Search ..... 162/168.5, 168.3, 168.4; 526/263; 525/326.7, 343, 359.5; 210/735, 736

[56] References Cited

U.S. PATENT DOCUMENTS 3,284,393 11/1966 Vanderhoff et al. .

4,067,876 1/1978 Ferruti et al. ..... 525/326.7

OTHER PUBLICATIONS

*Pulp and Paper,* Third Edition, vol. 3, edited by James P. Casey, John Wiley & Sons, New York, 1981, p. 1599, et seq.

H. Tanaka, K. Tachiki, & M. Sumimoto, Tappi, 62(1), 41–44 (1979).

*Primary Examiner*—William F. Smith

*Attorney, Agent, or Firm*—John G. Premo; Robert A. Miller; Donald G. Epple

[57] ABSTRACT

Certain copolymers with lower alkyl quaternary ammonium salts of 1-acryloyl-4-methyl piperazine, particularly copolymers containing acrylamide, give outstanding results as fine and filler retention agents used in the manufacture of paper.

5 Claims, No Drawings

RETENTION AIDS

INTRODUCTION

This invention, in general, relates to additives useful in the processing of paper. More particularly, this invention is concerned with improved polymeric compositions which show activity in retention of fillers and fiber fines in paper manufacture.

Paper is manufactured for the most part from wood pulp. A small amount of high grade paper is manufactured from rag pulp. There are five different kinds of wood pulp: mechanical pulp (ground wood), semi-chemical pulp, sulfite pulp, sulfate or kraft pulp and soda pulp. The first is prepared by purely mechanical means, the second by a combination of mechanical and chemical, and the other three by chemical means. The mechanical pulp contains substantially all of the wood except the bark and that lost during storage and transportation. Semi-chemical pulps are partially free of lignin. Chemical pulps, however, are essentially pure cellulose, the unwanted and unstable lignin and other non-cellulosic components of the wood having been dissolved away by the treatment. Because of this, chemical pulps are much superior to mechanical and semi-mechanical pulps for fine paper making. However, because of the special processing required, they are too expensive to serve as the main source of fiber for the cheaper grades of papers such as newsprint.

If the pulp fibers were the only constituents of a paper sheet, the usefulness of the paper would be very restricted because the sheet would be soft, have a yellowish color, and could not be written or printed upon with ink successfully. If the sheet were thin, it would be transparent to matter printed upon the opposite side. It is necessary, then, to add other substances, such as sizing, coloring agents, and fillers, to the cellulosic fibers to produce paper suited to its many uses.

Many papers, except the absorbent types, filter papers, and most packaging papers, must have a finely ground filler added to them, the purpose of which is to occupy the spaces between the fibers--thus giving a smooth surface, a more brilliant whiteness, improved printability and improved opacity. The fillers are inorganic substances and may be either naturally occurring materials such as talc, agalite, pearl filler, barytes and certain clays such as china clay or artificial fillers such as suitably precipitated calcium carbonate, crown filler (pearl hardening), blanc fixe, and titanium dioxide pigments. Sizing is added to the paper, other than absorbent papers and filter paper, to impart resistance to penetration by liquids. Common sizing agents added to the pulp before it is formed into a sheet are wax emulsions or soaps made by the saponification of rosin with alkali. The sizes are precipitated with alum.

Pulp stock is prepared for formation into paper by two general processes, beating and refining. Mills use either one or the other alone or both together. The most generally used type of beater is that known as the Hollander. Beating the fibers makes the paper stronger, more uniform, more dense, and less porous. It is in the beater that fillers, coloring agents and sizing may be added. The standard practice in making the finer grades of paper is to follow the beaters with the refiners, the latter being continuous machines.

While the usual practice is to add filler, sizing and color to the beaters, they may be added prior to the Jordan or to a combination of points in the system or subsequent to the beating operation but prior to the refining step, as for example, prior to beating. The order in which the materials are added to the beaters may vary with different mills. Generally, however, the filler is first added to the blended pulp, and after sufficient beating, the sizing and the coloring are added. In some instance, all or part of the sizing is surface applied to the formed, dried sheet, using animal glues, starches, or gelatin as the sizing. Again, alum is most generally added to the beater, but in some mills, this practice is varied, and the pulp may be treated with this chemical during the refining step or even later in the paper processing scheme.

The machines used for the actual formation of the paper sheet are of two general types, the Fourdrinier machine and the cylinder machine. The basic principles of operation are essentially the same for both machines. The sheet is formed on a traveling bronze screen or cylinder, dewatered under rollers, dried by heated rollers and finished by calender rolls. In the Fourdrinier machine, the stock of the foregoing operations is sent to the headbox from which it flows onto a moving, endless bronze wire screen. The pulp fibers remain on the screen while a greater portion of the water, containing unretained fiber fines and unretained filler, drains through. As the Fourdrinier wire moves along, it has a sidewise shaking motion which serves to orient some of the fibers and give better felting action and more strength to the sheet. While still on the Fourdrinier wire, the paper passes over suction boxes to remove water and under a dandy roll which smooths the top of the sheet. In the cylinder machine, there are several parallel vats into which similar or dissimilar dilute paper stocks are charged. A wire-covered rotating cylinder rotates in each vat. The paper stock is deposited on the turning screen as the water inside the cylinder is removed. As the cylinder revolves further, the paper stock reaches a point where the wet layer comes in contact with and adheres to the moving felt. This felt and paper, after removal of some water, come into contact with the top of the next cylinder and pick up another layer of wet paper. Thus, a composite wet sheet or board is built up and passed through press rolls and onto the drying and smoothing rolls.

In an attempt to improve filler and fines retention in the paper manufacturing operation several attempts have been made to incorporate chemical additives with the paper stock before it reaches either the cylinder vat or the Fourdrinier wire. These additives, for the most part, have not been entirely satisfactory from several operational points of view. One of the chief drawbacks of most chemicals used to improve a fiber and fine retention in the manufacture of paper is that they must possess certain characteristics and properties which are extremely difficult to achieve in any particular chemical. For instance, the particular chemical used should not be affected by other additives normally used in the paper processing operations such as rosin size, alum, sodium aluminate, starch, clays, and the like. Also important for a particular additive to be effective for improving fiber and fine retention is that it must not be affected by variations in pH. Similarly, the ideal additive chemical should not be affected by a particular electro-kinetic charge on the cellulose fibers and fines. The use of a chemical must, of course, be such that it does not have any adverse effects on the finished sheet and it should be relatively safe to handle.

In addition to possessing the above desirable characteristics, an additive for improving filler and fines retention must be capable of acting both upon the filler and fines in the system to efficiently cause such materials to be retained in the finished sheet rather than with one being preferentially acted upon by the additive. Another important characteristic that must be possessed by any chemical used as a filler and fines retention additive is that it must be capable of operating on a large variety of stocks.

Also of importance in the selection of fines and filler retention agent is that it must not affect dyestuffs which are frequently used as coloring agents for various types of paper stocks, nor must it interfere with the beneficial effects imparted to paper stocks by coatings which are frequently placed on different types of paper during its manufacture.

Many prior art filler and fiber fines retention aids fail to achieve the above desired objects. In addition, certain of these known retention additives cannot be employed in effective combinations with various fillers or other paper additives. Oftentimes efficiency is low except when gross uneconomical amounts are added. Adverse effects upon the finished paper product are noted when these retention aids cause poor dispersibility of the system additives with resultant localized non-uniform areas. Lastly, many additives fail by promoting filler trapage on the top side of the fiber material.

Fine and filler retention are further discussed in the well known textbook, *Pulp and Paper,* Third Edition, Volume 3, edited by James P. Casey, John Wiley & Sons, New York, 1981, at page 1599, et seq.

This work, in discussing fine and filler retentions, has a section dealing with cationic polyelectrolytes. This discussion is pertinent to the present invention and is reproduced below:

"Cationic Polyelectrolytes." Cationic charges are generated by introducing sulfonium, phosphonium, or ammonium groups onto the polymer backbone[1]. The ammonium ion is the one most commonly used for producing paper additives. An example of a monomer used as a copolymer agent is METAMS (methacryloyloxyethyl trimethyl ammonium methylsulfate), shown below:

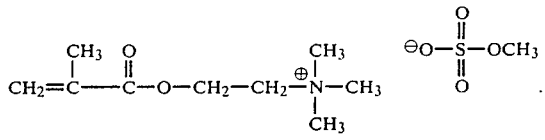

[1] C. P. Klass, A. J. Sharpe, and J. M. Urick, "Polyelectrolyte Retention Aids," in *Retention of Fines Solids During Paper Manufacture,* (TAPPI C. A. Report No. 57), 1975, p. 55.

"The molecular weight of these products often exceeds 1,000,000, with a wide variety of charge densities and molecular weights available."

"The cationic polymers have the advantage of being readily adsorbed by the normally negative surfaces encountered in the wet-end system, thus eliminating the necessity of using intermediaries such as alum. The high molecular weight allows for the formation of many loops on adsorption, thus providing many bonding points. This results in a strong, tenacious bridge. In one study[2] of a number of different cationic polymers including polyacrylohydrazide, polyvinylpyridine, glycol-chitosan, cationic starch (diethylaminoethyl starch), polyethyleneimine, and polydiethylaminoethylmethacrylate, it was shown that the primary factor causing adsorption is charge interaction and that the extent of adsorption on pulp fibers varies with the pH, with the optimum adsorption tending to shift toward a higher pH as the basicity of the amino group is increased."

[2] H. Tanaka, K. Tachiki, and M. Sumimoto, TAPPI, 62 (1), 41–44 (1979).

It, therefore, becomes an object of the invention to provide new water-soluble cationic polymeric materials which are useful as filler and fiber fines retention aids.

Another object of the invention is to provide a new and improved method for improving filler and fines retention in the manufacture of paper by addition of novel polymeric substances during paper processing.

A further object is to provide chemical agents for improving filler and fines retention which are effective at low economical dosages, will not interfere with other additives and substances used in the make-up and manufacture of the paper, and which have no adverse effects on the chemical and physical characteristics of the finished sheet.

An important object of the invention is to provide chemical additives for improving filler and fine retention in manufactured paper which will operate on a wide variety of paper stocks, are fairly safe to handle and will impart to the finished sheet certain and desirable characteristics which have not heretofore been available when prior attempts have been made to use other chemicals as fines and filler retention aids.

THE INVENTION

An improved method for improving fine and filler retention of paper during its manufacture into a sheet from pulp which comprises treating the pulp prior to sheet formation with a fine and filler retention retaining amount of a copolymer which contains between 2–50 mole percent of a lower alkyl quarternary ammonium salt of 1-acryloyl-4-methyl piperazine which has a molecular weight of at least 1,000,000.

The Lower Alkyl Quaternary Ammonium Salts of 1-Acryloyl-4-Methyl Piperazine

The starting vinyl monomers used to prepare the quaternary ammonium salts of 1-acryloyl-4-methyl piperazine are typical lower alkyl substituted quaternizing agents. The term, "lower alkyl," as used herein means lower alkyl groups containing alkyl radicals of from 1–4 carbon atoms, thus the starting materials to prepare the quarternary derivatives are exemplified by methyl chloride or dimethyl sulfate. Other typical materials that could be used are ethyl chloride, ethyl bromide, diethyl sulfate, propyl chloride, and butyl bromide.

Of the above starting materials, the methyl chloride and dimethyl sulfate are preferred.

The monomers may be either homopolymerized or may be copolymerized with other vinyl addition monomers capable of being polymerized with the monomers of this invention. The copolymers should be prepared from monomers that render the finished copolymers water-soluble. A particularly useful copolymer may be prepared by polymerizing the monomers of this invention with acrylamide.

Suitable copolymers useful in this invention are prepared using such monomers as acrylamide, meth acrylamide, acrylonitrile, vinyl acetate, methylacrylate, methyl meth acrylate, ethyl acrylate, ethyl methylacrylate, styrene, etc. All that is important is that the comonomer be capable of polymerizing, or have suitable reactivity ratios, with the monomers of this invention. Generally when copolymerized, such copolymers will contain from 1–99 mole percent, preferably 1–70 mole percent and most preferably 2–50 mole percent of the vinyl piperazine.

The polymers and copolymers of the invention can be prepared either using conventional solution polymerization techniques or the so-called inverse emulsion polymerization method which utilizes polymerization of water-soluble vinyl monomers in the form of water-in-oil emulsions. This technique is described in Vanderhoff, U.S. Pat. No. 3,284,393, the disclosure of which is incorporated herein by reference.

EXAMPLES

To illustrate the preparation of the vinyl piperazine monomer used to prepare the polymers used in the invention, the following are given by way of example:

EXAMPLE 1

Synthesis of 1-acryloyl-4-methyl piperazine

Acryloyl chloride (90.5 g) in methylene chloride (100 ml) was added into a methylene chloride (500 ml) solution of N-methyl piperazone (100 g) over a period of one hour. The reaction temperature was kept below 25° C. with cooling. After the addition was completed, the reaction mixture was stirred at ambient temperature for two hours. Then, sodium carbonate (53 g) in 250 ml. of water was added into the reaction mixture with stirring. A crude product (76 g) of 1-acryloyl-4-methyl piperazine was recovered from the methylene chloride solution. The product was distilled and the fraction collected at 65°–69° C./1.5 mm Hg was characterized by I.R. and C13 NMR and was found to be 97% pure by G. C.

EXAMPLE 2

Quaternization of 1-acryloyl-4-methyl piperazine

Dimethyl sulfate (45.8 g) was added slowly into 1-acryloyl-4-methyl piperazine (54.3 g) in water (99 g) with cooling so that the reaction temperature was kept below 30° C. After the addition was completed, the reaction mixture was stirred at ambient temperature for two hours. The product was characterized by C13 NMR.

Into a 300 ml Parr bomb was charged water (92.9 g), 1-acryloyl-4-methyl piperazine (70 g) and methyl chloride (27 g). The valves were closed and the bomb was heated to and maintained at 45° C. for four hours. C13 NMR of the product showed 90% of the starting amine was converted to quaternary salts.

The Molecular Weight of the Polymers

The invention, to give optimum results in fine and filler retention, requires that the copolymers have a molecular weight of at least 1,000,000 with molecular weights within the range of 3,000,000–20,000,000 being preferred.

The Mole Ratio and RSV of the Polymers

In order to give optimum results, it is desirable that the copolymers contain between 2–50 mole percent of the lower alkyl quaternary ammonium salt of 1-acryloyl-4-methyl piperazine. As will be shown hereafter, it is preferred when the dimethyl sulfate or methyl chloride quaternary ammonium salt of 1-acryloyl-4-methyl piperazine is used that it be present at between 2 to 34 mole percent when this cationic monomer is combined as a copolymer with acrylamide. Such preferred copolymers are further characterized as having an RSV[3] in the range of 8–28.

[3] RSV = Reduced Specific Viscosity.

Synthetic Techniques

In order to obtain the molecular weights and other desirable properties described above when using the copolymers of the invention, it is usually necessary to employ the so-called water-in-oil emulsion technique described in the Vanderhoff, U.S. Pat. No. 3,284,393.

The polymerization procedure and its utilization in preparing a typical copolymer of the invention is described below:

The Water-in-Oil Emulsions of the Methyl Chloride or Methyl Sulfate Quaternary Ammonium Salts of 1-Acryloyl-4-Methyl Piperazine The water-in-oil emulsions of the methyl chloride or methyl sulfate quaternary ammonium salts of 1-acryloyl-4-methyl piperazine (hereinafter water-soluble vinyl addition polymers) contain four basic components. These components and their weight percentages in the emulsions are listed below:

A. Water-soluble vinyl addition polymer:
   1. Generally from 5–60%;
   2. Preferably from 20–40%; and
   3. Most preferably from 25–35%;

B. Water:
   1. Generally from 20–90%;
   2. Preferably from 20–70%; and
   3. Most preferably from 30–55%;

C. Hydrophobic liquid:
   1. Generally from 5–75%;
   2. Preferably from 5–40%; and
   3. Most preferably from 20–30%; and D. Water-in-Oil emulsifying agent:
   1. Generally from 0.1–21%;
   2. Preferably from 1–15%;
   3. Most preferably from 1.2–10%.

It is also possible to further characterize the water-in-oil emulsions of water-soluble vinyl addition polymers with respect to the aqueous phase of the emulsions. This aqueous phase is generally defined as the sum of the polymer or copolymer present in the emulsion plus the amount of water present in the emulsion. This terminology may also be utilized in describing the water-in-oil emulsions which are useful in this invention. Utilizing this terminology, the aqueous phase of the water-in-oil emulsions of this invention generally consists of 25–95% by weight of the emulsion. Preferably, the aqueous phase is between 60–90% and, most preferably, from 65–85% by weight of the emulsion.

The emulsions also may be characterized in relation to the water/oil ratios. This figure is simply a ratio of the amount of water present in the emulsion divided by the amount of hydrophobic liquid present in the emulsion. Generally, the water-in-oil emulsions of this invention will have a water-oil ratio of from 0.25 to 18. Preferably, the water-in-oil ratio will range from 0.5–14, and, most preferably, from 1.0–2.75.

EXAMPLE 3

Oil Phase:

-continued

| | |
|---|---|
| LOPS[4] | 130 |
| Sorbitan Monooleate | 7.5 |
| 4 moles EO reacted with Sorbitan Monostearate | 2.5 g |
| Aqueous Phase: | |
| 50% AMPIP MSQ[5] | 51.25 |
| 46.4% Acrylamide solution | 246.49 |
| $H_2O$ | 59.92 |
| Versene | .05 g |
| Initiator: | |
| 2,2'-Azobisisobutyronitrile | .28 g |

[4]LOPS = Parrafin oil.
[5]AMPIP MSQ = 1-acryloyl-4-methyl piperazine dimethyl sulfate quat.

The oil phase and the aqueous phase with pH adjusted to 4.5 were first prepared and the emulsion was obtained by adding the aqueous solution into the LOPS solution with vigorous stirring.

The emulsion was purged with nitrogen for ½ hour and then heated to 45° C. The initiator was added and the reaction was maintained at 45° C. for four hours and at 65° C. for one hour. The reaction was stopped and cooled to room temperature. G. C. and L. C. analyses show the product contained only 350 ppm and less than 500 ppm of AMPIP MSQ and acrylamide respectively. The IV of the copolymer was 16.5 and the RSV (@ 0.045 g in 100 cc 1 M $NaNO_3$) was 21.9.

Using the above polymerization techniques, a variety of homo and copolymers of the invention were prepared. The results of these syntheses are set forth below in Table I.

For purposes of comparison, a typical solution copolymerization of dimethyl sulfate quat of 1-acryloyl-4-methyl piperazine with acrylamide is presented below in Example 4:

EXAMPLE 4

This example illustrates a typical solution polymerization of the dimethyl sulfate quaternary ammonium salt of 1-acryloyl-4-methyl piperazine.

The following represented a charge to a polymerization reaction flask:

| | |
|---|---|
| 50% AMPIP MSQ | 20.0 g |
| $H_2O$ | 70.8 g |
| 2% ethylenediamine tetraacetic acid solution (Versene) | 1 ml. |

The above charge was heated to 60° C. at which time 0.35 g. of ammonium persulfate in 5 ml. water was added to the contents of the flask. The reaction temperature was maintained at 60° C. for 3 hours, at which point another 0.35 g. of ammonium persulfate solution was added. It was then heated for about 1 hour at 70° C. to complete the polymerization. The conversion was 91.4%. The intrinsic viscosity was 0.20. The Reduced Specific Viscosity at 0.045 g/100 c.c 1 M $NaNO_3$, 30° C. was 0.20. The molecular weight was $1.8\times10^4$, and the Huggins Constant was 0.303.

When the polymers of the invention are used to improve fine and filler retention, they show activity at dosages as low as 0.01 lb./ton based on the weight of dry fiber. More preferably, the additives are employed in a level of at least 0.1 pound per ton. The polymers of the invention have unusually good water-solubility, notwithstanding the high molecular weights of the products, and may be used as retention aids for all fiber furnishes including both bleached and unbleached primary or virgin chemical pulps, mechanical pulps, and secondary fibers, that is, fibers previously employed as paper stock.

EXAMPLE 5

Tables I and II following show the results achieved in using the polymers described herein for fine and filler retention.

TABLE I

| | | | | | RETENTION EVALUATION | | | | | | |
|---|---|---|---|---|---|---|---|---|---|---|---|
| | | | | | Replacement Ratios (vs. Comp. 6) | | | | | | 2% Sol. Viscosity |
| Sample | Type | I.V. | Wt. % Solids | RSV | Lab-Acid[1] Furnish | Lab[2] Alkaline Furnish | Commercial[2] Paper 1 | Commercial[2] Paper 2 | Commercial[2] Paper 3 | 2% Sol. pH | (Spindle #2 30 RPM) |
| Comp. 1 | 5.4 mole % latex copolymer AMPIQ/ACAM[3] | 16.5 | 28.1 | 21.9 | .8 | .7 | .5 | .80 | 0.4 | 8.12 | 477 |
| Comp. 2 | 10 mole % latex copolymer AMPIQ/ACAM[3] | 14.2 | 27.8 | 18.7 | .6 | .7 | .5 | .95 | .80 | 8.00 | 659 |
| Comp. 3 | 15 mole % latex copolymer AMPIQ/ACAM[3] | 11.8 | 27.9 | 14.3 | .6 | .8 | — | — | — | 8.01 | 606 |
| Comp. 4 | 34 mole % latex copolymer AMPIQ/ACAM[3] | 11.0 | 27.9 | 12.9 | .6 | 1.0 | — | — | — | 7.89 | 820 |
| Comp. 5 | 50 mole % latex copolymer AMPIQ/ACAM[3] | 6.1 | 27.9 | 7.25 | 1.2 | 1.1 | — | — | — | 7.83 | 485 |
| Comp. 6 | 5.4 mole % MAPTAC/AcAM | — | 28.0 | 13.0 | 1.0 (ref) | 1.0 (ref) | 1.0 (ref) | 1.0 (ref) | 1.0 (ref) | — | — |

[1]Replacement ratios were calculated at 50% improvement over the blank.
[2]Replacement ratios were calculated at 40% improvement over the blank.
[3]1-Acryloyl-4-methyl piperazine/dimethyl sulfate quat/acrylamide.

TABLE II

| Sample | Type | I.V | Wt. % Solids | RSV | Dosage Lb/Ton Actives | Norm Mullen Average | % Impr. Mullen | Norm Tensile Average | % Impr. Tensile |
|---|---|---|---|---|---|---|---|---|---|
| | | | Dry Strength Performance | | | | | | |
| Blank | — | — | — | — | — | 77.9 | — | 14.29 | — |
| Comp. 7 | 10 mole % solution copolymer AMPIQ/ACAM* | 3.97 | 4.96 | 4.27 | 10 | 76.9 | −1.30 | 14.16 | −.91 |
| | | | | | 20 | 82.0 | 5.30 | 16.07 | 12.50 |
| Comp. 8 | 20 mole % solution copolymer AMPIQ/ACAM* | 3.91 | 5.00 | 4.67 | 10 | 78.4 | .65 | 14.10 | −1.33 |
| | | | | | 20 | 81.0 | 3.80 | 14.60 | 2.20 |
| Comp. 9 | 30 mole % solution copolymer AMPIQ/ACAM* | 5.60 | 5.00 | 6.00 | 10 | 82.8 | 6.30 | 15.22 | 6.51 |
| | | | | | 20 | 83.3 | 6.90 | 12.81 | −10.36 |
| Comm. Product | Sodium acrylate acrylamide | — | 100 (dry) | — | 10 | 82.7 | 6.20 | 16.22 | 13.50 |
| | | | | | 20 | 82.3 | 5.60 | 15.72 | 10.00 |

*1-Acryloyl-4-methyl piperazine/dimethyl sulfate quat/acrylamide

CONCLUSIONS

Retention

1. Performance was equivalent or better than Comp. 6 for all AMPIQ samples with 5.4 to 35 mole % charge and RSV 12.9–21.9 (replacement ratios 0.6–1.0).

2. The 50 mole % AMPIQ with an RSV=7.25 was slightly less active than other samples tested. Replacement ratio was 1.1–1.2.

3. The 5.4 and 10 mole % formulations (Comp. 1) and Comp. 2) were evaluated in three paper mills. Both had very good activity with replacement ratios of 0.4–0.95.

Dry Strength

1. None of the AMPIQ copolymers were better than the commercial product for mullen burst or dry tensile strength.

2. With the AMPIQ samples, 1 to 7 percent improvement was seen in mullen strength while 2 to 13 percent improvement was obtained in tensile strength.

Having thus described my invention, I claim:

1. A method for improving fine and filler retention of paper during its manufacture into a sheet from pulp which comprises treating the pulp prior to sheet formation with a fine and filler retention retaining amount of a copolymer which contains between 2–50 mole percent of a lower alkyl quaternary ammonium salt of 1-acryloyl-4-methyl piperazine which has a molecular weight of at least 1,000,000.

2. The method of claim 1 where the copolymer is an acrylamide copolymer and the lower alkyl quaternary ammonium salt of 1-acryloyl-4-methyl piperazine is from the group consisting of the methyl chloride or dimethyl sulfate quaternary ammonium salt.

3. The method of claim 2 where the mole percent is within the range of 2:34.

4. The method of claim 3 where the copolymer has an RSV between 8–28.

5. The improved method of claim 1 where the lower alkyl quaternary ammonium salt of 1-acryloyl-4-methyl piperazine is in the form of a water-in-oil emulsion prior to being added to the pulp.

* * * * *